US007249872B2

(12) United States Patent
Ragsdale et al.

(10) Patent No.: US 7,249,872 B2
(45) Date of Patent: Jul. 31, 2007

(54) METHOD AND SYSTEM FOR DISPLAYING LIGHTING FIXTURES

(75) Inventors: Joy Ragsdale, Miami, FL (US); Jose Campo, Miami, FL (US); Balraj Narang, Mississauga (CA)

(73) Assignee: Catalina Lighting Inc., Miami, FL (US)

( * ) Notice: Subject to any disclaimer, the term of this patent is extended or adjusted under 35 U.S.C. 154(b) by 69 days.

(21) Appl. No.: 11/245,295

(22) Filed: Oct. 6, 2005

(65) Prior Publication Data

US 2007/0081347 A1 Apr. 12, 2007

(51) Int. Cl.
*F21S 13/02* (2006.01)

(52) U.S. Cl. ..... 362/432

(58) Field of Classification Search .. 211/90.01–94.03; 362/432, 147

See application file for complete search history.

(56) References Cited

U.S. PATENT DOCUMENTS 3,504,172 A 3/1970 Liberman
3,885,147 A * 5/1975 Chacon ..... 362/408
3,945,467 A 3/1976 Levitz
4,017,137 A * 4/1977 Parks ..... 439/135
4,108,085 A * 8/1978 Shepherd et al. ..... 108/108
4,489,995 A * 12/1984 Barr ..... 312/236
4,747,025 A * 5/1988 Barton ..... 362/147
4,775,921 A * 10/1988 Foley ..... 362/147
4,805,863 A * 2/1989 Armstrong et al. ..... 248/243
4,891,897 A * 1/1990 Gieske et al. ..... 40/618
5,086,194 A * 2/1992 Bruinsma ..... 174/494
5,101,989 A * 4/1992 Jones ..... 211/94.01
5,142,460 A 8/1992 McAtee
5,142,832 A 9/1992 Branham, Sr. et al.
5,228,579 A * 7/1993 Kaufman ..... 211/94.01
5,277,005 A * 1/1994 Hellwig et al. ..... 52/220.1
5,305,898 A * 4/1994 Merl ..... 211/87.01
5,348,485 A * 9/1994 Briechle et al. ..... 439/110
5,425,648 A * 6/1995 Farham ..... 439/116
5,454,638 A * 10/1995 Bird et al. ..... 312/408
5,472,103 A * 12/1995 Merl ..... 211/187
5,495,952 A * 3/1996 Kainz ..... 211/90.04
5,509,541 A * 4/1996 Merl ..... 211/103
5,606,919 A * 3/1997 Fox et al. ..... 108/50.02
5,697,507 A * 12/1997 Blass ..... 211/94.01
5,769,247 A * 6/1998 Merl ..... 211/103
5,816,550 A * 10/1998 Watanabe et al. ..... 248/222.11
5,857,577 A * 1/1999 Thomas et al. ..... 211/94.01
5,899,035 A * 5/1999 Waalkes et al. ..... 52/239
6,082,557 A * 7/2000 Leahy ..... 211/59.3
6,082,690 A * 7/2000 Durin et al. ..... 248/241
6,119,878 A * 9/2000 Zen ..... 211/94.01
6,161,708 A * 12/2000 Myler ..... 211/90.02
6,180,878 B1 * 1/2001 Gretz ..... 174/504

(Continued)

*Primary Examiner*—Ross Gushi
(74) *Attorney, Agent, or Firm*—Mark Montague; Cowan, Liebowitz & Latman, P.C.

(57) ABSTRACT

A lighting fixture display system and method including a light support member for supporting truncated floor-based lighting fixtures and a rail member. The light support members have shelf structures and brackets and are mounted on or attached to the rail member, which in turn may be mounted on or attached to a display wall. The rail members and light support members may be configured to form a display system having multiple horizontal display rows. The display system makes efficient use of retail space, is easy to build, and can be varied to enable various different display configurations as well as allow easy replacement or repair of lighting fixtures.

25 Claims, 9 Drawing Sheets

U.S. PATENT DOCUMENTS 6,199,705 B1 * 3/2001 Portner ..... 211/26
6,220,463 B1 * 4/2001 Pullen ..... 211/186
6,244,733 B1 * 6/2001 Fong et al. ..... 362/391
6,276,034 B1 * 8/2001 Bachman et al. ..... 27/27
6,280,066 B1 * 8/2001 Dolan ..... 362/414
6,281,434 B1 * 8/2001 Gretz ..... 174/502
6,325,223 B1 * 12/2001 Hannen ..... 211/87.01
6,390,644 B1 * 5/2002 Dolan ..... 362/250
6,408,579 B1 * 6/2002 Anderson et al. ..... 52/220.7
6,499,608 B1 * 12/2002 Sterling et al. ..... 211/70.6
6,527,565 B1 * 3/2003 Johns ..... 439/116
6,570,492 B1 * 5/2003 Peratoner ..... 340/310.11
6,659,295 B1 * 12/2003 De Land et al. ..... 211/187
6,716,042 B2 * 4/2004 Lin ..... 439/110
6,747,204 B2 * 6/2004 DeLand ..... 174/50
6,763,957 B1 * 7/2004 Mullerleile ..... 211/94.01
6,883,671 B2 * 4/2005 Rushing ..... 211/88.01
6,910,306 B2 * 6/2005 Waalkes et al. ..... 52/239
6,918,499 B2 * 7/2005 De Land et al. ..... 211/187
6,929,131 B1 * 8/2005 Landi ..... 211/87.01
6,932,225 B2 * 8/2005 Rowe ..... 211/90.02
6,945,414 B1 * 9/2005 Stevens et al. ..... 211/94.01
7,001,050 B2 * 2/2006 Beasley et al. ..... 362/414
7,007,912 B1 * 3/2006 Giuliani et al. ..... 248/552
7,160,005 B1 * 1/2007 Pape et al. ..... 362/351
7,172,332 B2 * 2/2007 Mobarak et al. ..... 362/649
2001/0047971 A1 * 12/2001 Chance et al. ..... 211/87.01
2002/0064049 A1 * 5/2002 Layne et al. ..... 362/404
2002/0085373 A1 * 7/2002 Slesinger et al. ..... 362/127
2003/0000905 A1 * 1/2003 Zidek ..... 211/205
2003/0052073 A1 * 3/2003 Dix ..... 211/90.02
2003/0189019 A1 * 10/2003 Campbell et al. ..... 211/94.01
2003/0205545 A1 * 11/2003 Moceri ..... 211/90.02
2005/0173605 A1 * 8/2005 Villeneuve et al. ..... 248/301
2005/0263465 A1 * 12/2005 Chung ..... 211/90.02
2006/0027516 A1 * 2/2006 Chen ..... 211/183

* cited by examiner

METHOD AND SYSTEM FOR DISPLAYING LIGHTING FIXTURES

FIELD OF THE INVENTION

The present invention relates to a lighting fixture display apparatus and, more particularly, to a system and method for displaying multiple types of floor-based lighting fixtures in a shelf-like structural manner.

BACKGROUND OF THE INVENTION

Consumer selection of lamps and other lighting fixtures is primarily based on functionality and appearance. Many different lighting options and lamp and fixture designs exist, such as table lamps, floor lamps, and wall-mounted and ceiling-mounted fixtures, among many others. Each type of lighting fixture or lamp is made in a variety of styles and designs. For example, the manufacture and sale of decorative lamp shades for table lamps is an industry in and of itself. A retailer of lighting fixtures or lamps is more likely to present a customer with one or more items that he or she will want to purchase if the customer is able to choose from a large number of designs and styles of any one kind of lighting fixture. Therefore, a retailer will generally want to maximize the number of items that a customer can conveniently view in the retailer's available space. In addition, it is advantageous for a retailer of such items to be able to display them so that the decorative features of each item can be readily and easily seen without manipulation by the retailer or customer handling.

Another consideration for retailers of lighting fixtures and lamps is the flexibility of a display system to enable the retailer to rapidly and easily modify the items on display, whether to update a line of items, remove old or damaged items, or reconfigure the display to accommodate more or fewer items, depending on the size of each lamp or fixture and the overall appearance of the display. The requirement that an electrical connection be available for each item can limit the flexibility of any lighting display system.

With respect to table lamps and wall-mounted and ceiling-mounted lighting fixtures, a number of systems have been developed to meet retailers' needs. In particular, systems for displaying lamps on tilted shelves, such as disclosed in U.S. Pat. No. 6,280,066 and U.S. Pat. No. 6,390,644, maximize retail space for displaying various types of lamps and enable the items to be displayed at an angle so that the decorative base of each lamp can be seen. Another example is the energy efficient system for displaying wall-mounted and ceiling-mounted lighting fixtures, as described in U.S. Pat. No. 5,142,460, in which the ceiling-mounted lighting fixtures are supported by horizontally-extending projections that are permanently attached to a vertical wall.

Further examples include: U.S. Pat. No. 4,775,921, which discloses a lighting fixture display system that supports wall-mounted lighting and related items; U.S. Pat. No. 6,199,705, which discloses a system including a vertical grooved panel and plurality of horizontal brackets mounted thereon for displaying electrical fixtures including wall-mounted lighting fixtures; and U.S. Pat. No. 3,885,147, which discloses a system of fixture-supporting brackets that extend vertically or diagonally from wall-mounted channel members.

Floor lamps such as torchieres present unique problems to a retailer. Such lamps usually have a tall stem portion with a base and a bowl-shaped top part that diffuses the light or directs it upward. The top bowl-shaped part likely has the most decorative features and must be viewable to customers. Floor lamps take up a significant portion of a retailer's floor space, and cannot be practically displayed elsewhere without obscuring or making it difficult for a customer to see the decorative features of the top bowl-shaped part. Like a table lamp, a floor lamp usually requires an electrical connection at its base. However, due to the dimensions and unwieldy shape of most floor lamps, displaying such lamps anywhere other than on the floor has been a practical impossibility.

OBJECTS AND SUMMARY OF THE INVENTION

In view of the foregoing, it is an object of the invention to provide a lighting fixture display system for displaying floor-based lighting fixtures in a manner that is attractive and relatively space efficient.

It is another object of the invention to provide a lighting fixture display system that is designed to minimize the need for manipulation or handling of the fixtures by the retailer or customer in order for the fixture to be viewed.

It is a further object of the invention to provide a lighting fixture display system that is relatively easy to set up and that is also sufficiently flexible to allow variation in the size, quantity, and style of lighting fixtures or lamps displayed and to allow variation of the overall configuration of the lighting fixture display.

In accordance with one embodiment of the present invention, a lighting fixture display system comprises a support member and a rail member. The support member includes a shelf structure and a bracket for attachment to the shelf structure. The support member is coupled to the rail member, which provides an electrical connection, and each support member is adapted to support a lighting fixture.

As an aspect of the present embodiment, the shelf structure is adapted to receive a segment of the rail member.

As a further aspect of this embodiment, the bracket is attached, at one end, to the shelf structure, and at an opposite end, to the rail member.

As another aspect of this embodiment, a plurality of support members are disposed along the length of the rail member, for the display of a plurality of lighting fixtures.

As yet another aspect of this embodiment, a plurality of rail members are provided, to which a plurality of support members are coupled, forming at least first and second horizontal display rows.

As another aspect of this embodiment, the lighting fixture display system further comprises a display wall, to which the plurality of rail members can be attached to form a plurality of variously configurable horizontal display rows.

In accordance with another embodiment of the present invention, a lighting fixture display system comprises a plurality of support members, each of which includes a shelf structure and a bracket for attachment to the shelf structure, a rail member which provides an electrical connection, and a plurality of lighting fixtures. Each of the lighting fixtures is supported by a respective one of the support members, and each support member is coupled to the rail member.

As an aspect of this embodiment, each of the support members is disposed along the rail member so as to be adapted to support a respective one of the lighting fixtures without interfering with an adjacent lighting fixture supported by another support member.

As another aspect of this embodiment, the display system includes a plurality of rail members to which the plurality of support members are coupled, forming at least first and second horizontal display rows, and a display wall on which the plurality of rails may be mounted. A first plurality of support members are coupled to and disposed along the first display row, a second plurality of support members are coupled to and disposed along the second display row, a first plurality of lighting fixtures being supported by selected ones of the first plurality of support members, and the second plurality of lighting fixtures being supported by selected ones of the second plurality of support members.

As yet another aspect of this embodiment, each support member comprises a plurality of brackets, each of which is attached, at one end, to the respective shelf structure and is attached, at an opposite end, to one of the plurality of rail members.

As an additional aspect of this embodiment, each of selected ones of the support members is adapted to support a truncated floor lamp.

As a feature of this aspect, the shelf structure of each support member is formed with an aperture through which an electrical cord can be threaded and connected to the electrical connection provided by the rail member.

In accordance with a further embodiment of the present invention, a method of setting up a lighting fixture display system comprises the steps of providing a rail member and a plurality of support members, each support member including a shelf structure and a bracket, each shelf structure adapted to receive, at one end, the rail member; connecting each shelf structure to the rail member with a bracket; and installing a plurality of lighting fixtures on the shelf structures of the support members.

As an aspect of this embodiment, the installing step is carried out by installing each of the plurality of lighting fixtures on a respective one of the shelf structures.

As another aspect of this embodiment, each of the support members is positioned on the rail member so that a lighting fixture supported by a support member does not interfere with a lighting fixture supported by an adjacent support member.

As a further aspect of this embodiment, the step of providing a support member comprises providing a plurality of rail members and a plurality of shelf structures defining at least first and second display rows; the connecting step comprises connecting a first plurality of shelf structures to a first rail member with a first plurality of brackets and connecting a second plurality of shelf structures to a second rail member with a second plurality of brackets; and the installing step comprises installing a first plurality of lighting fixtures along the first display row, and installing a second plurality of lighting fixtures along the second display row.

As an additional aspect of this embodiment, the providing step further comprises providing a shelf member having an aperture and the installing step of installing a lighting fixture on the shelf member further comprises threading an electrical cord of the lighting fixture through the aperture of each shelf member so that each of the support members supports a truncated floor-based lighting fixture.

As yet a further aspect of this embodiment, the method further comprises the step of removing a selected one of the lighting fixtures from one of the support members without interfering with lighting fixtures supported by adjacent support members.

Various other objects, advantages and features of the present invention will become readily apparent to those of ordinary skill in the art, and the novel features will be particularly pointed out in the appended claims.

BRIEF DESCRIPTION OF THE DRAWINGS

The following detailed description, given by way of example and not intended to limit the present invention solely thereto, will best be appreciated in conjunction with the accompanying drawings, in which.

DETAILED DESCRIPTION OF THE INVENTION

Figure 1:
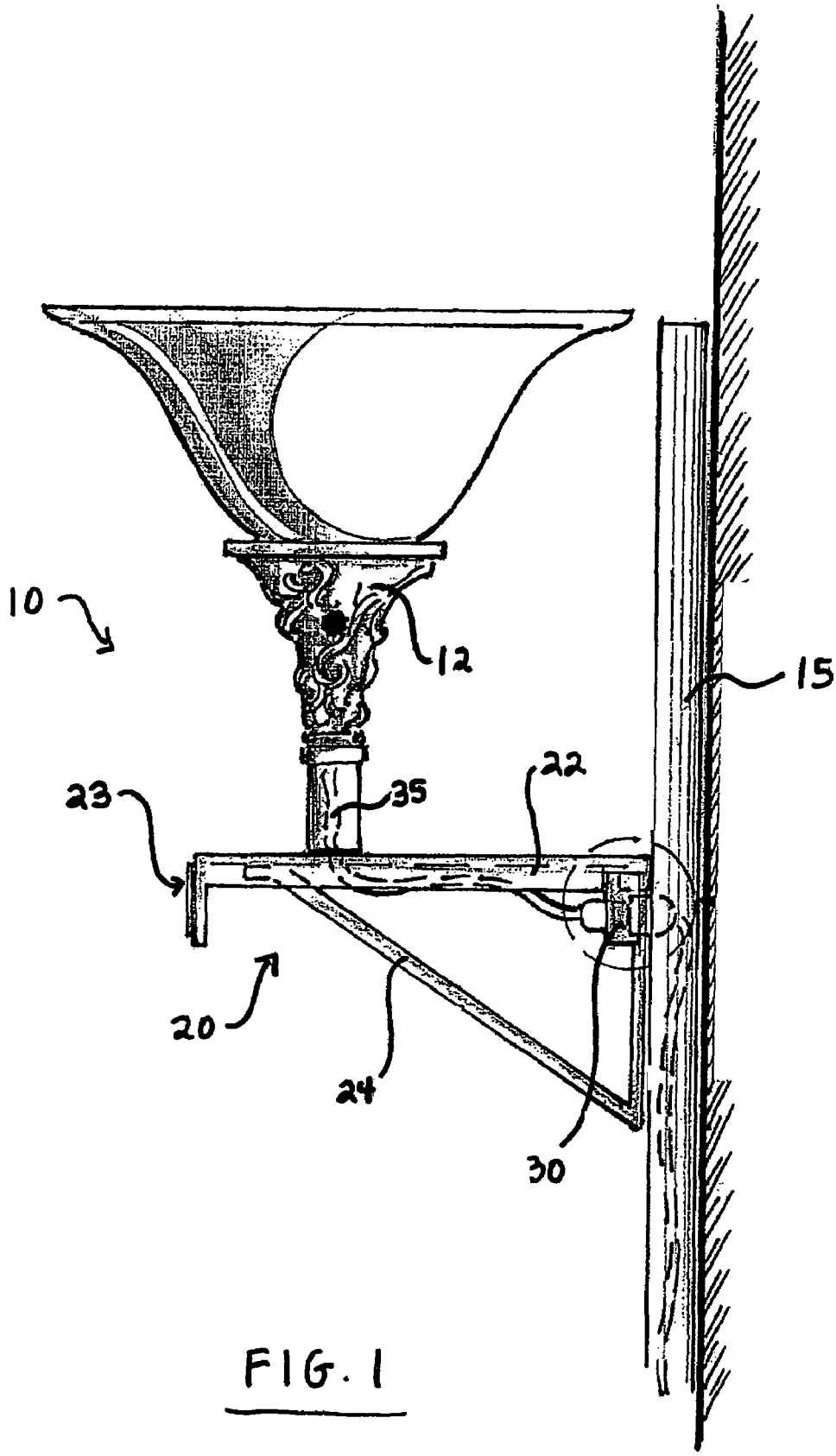
FIG. 1 is a schematic drawing of a side view of an exemplary lighting fixture display system showing a lighting fixture supported thereby in accordance with one embodiment of the present invention.

FIG. 1 is a schematic drawing of an exemplary lighting fixture display system in accordance with the present invention. Lighting fixture display system 10 (hereinafter, display system 10) enables the display of a truncated floor-based lighting fixture 12, along a vertical wall or display wall 15, in a manner that is easy to assemble and is attractive to customers. As can be seen in FIG. 1, the truncated floor-based lighting fixture 12 includes a stem portion and a bowl-shaped top part. The shape and size of the top bowl-shaped part and the decorative features in the area where the top bowl-shaped part meets the stem are usually the most important features of a floor-based lamp for the customer to be able to see.

The display system 10 includes a support member 20 and rail member 30 to which the support member is attached. The rail member 30 may be mounted on or attached to the display wall 15. The rail member 30 also provides an electrical connection to receive an electrical cord 35 from the truncated lighting fixture 12. The support member 20 includes a shelf structure 22 which extends horizontally outward from the vertical display wall 15. As shown in FIG. 1 and described in further detail below with reference to FIGS. 5A-5C, the shelf structure 22 is adapted to receive or fit onto the rail member 30 at its end closest to the display wall 15. The shelf structure 22 is also adapted to support a truncated lighting fixture 12, as will also be described in further detail. A label 23 or other display identifying object may be placed at the end of the shelf structure 22 opposite the display wall 15, as more clearly shown in FIG. 2.

A bracket 24 supports the shelf structure 22 and is attached thereto at an end opposite the display wall 15. The bracket 24 is coupled between the shelf structure 22 and the rail member 30, which as noted above is attached to the display wall 15. In other embodiments, such as that shown in FIG. 4, the bracket 144 is coupled between a shelf structure and a second rail member and provides additional support to the shelf structure. As shown in FIG. 1, the bracket 24 may be formed as an angled member with one portion disposed at an angle to the shelf structure 22, which reinforces the shelf structure, and a second portion disposed parallel to the display wall 15 and extending between the rail member 30 and the display wall 15. As will be described in further detail below with reference to FIGS. 6A and 6B, the bracket 24 may have a variety of other shapes, sizes and configurations for attachment of the shelf structure 22 to a rail member 30 and to reinforce the support member 20.

The particular dimensions of the display system 10 may be modified to accommodate the space available within the retail establishment, and further can be adapted to accommodate truncated floor lamps of different shapes and sizes.

Figure 2:
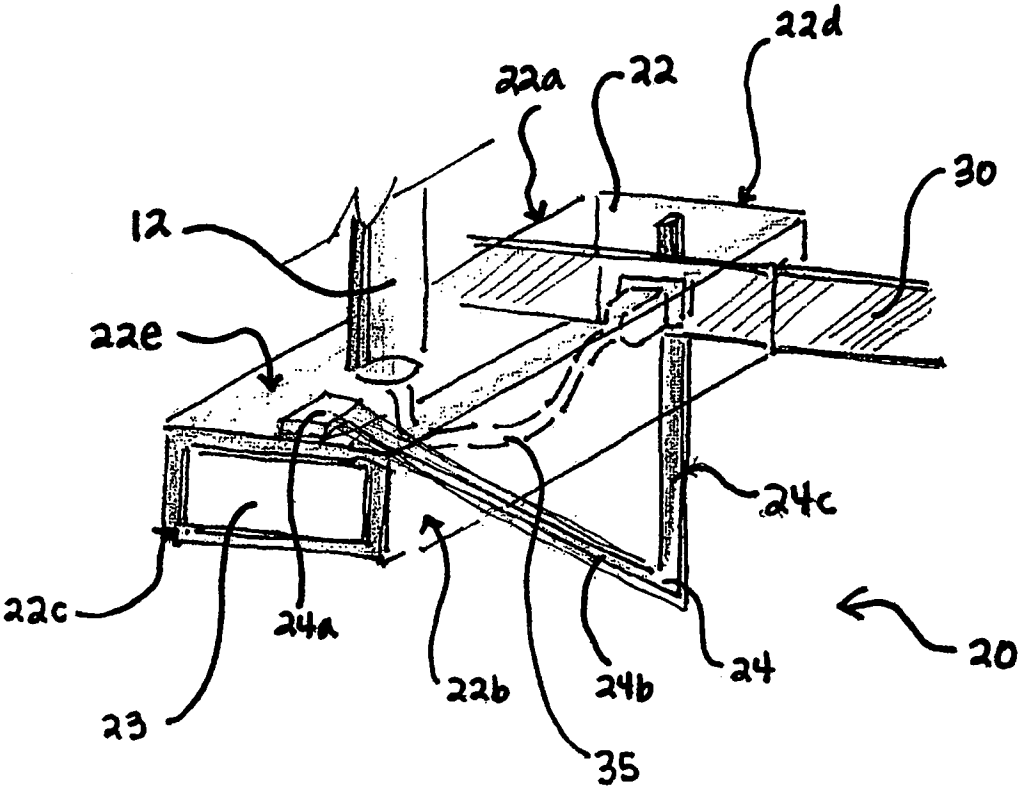
FIG. 2 is a schematic drawing of a perspective view of the lighting fixture display system of FIG. 1.

FIG. 2 is a schematic drawing of a perspective view of the lighting fixture display system of FIG. 1 with the truncated floor-based lighting fixture 12 supported thereby. As can be seen in this view, the support member 20 includes shelf structure 22 which has side walls 22*a*, 22*b* adapted to receive or hook onto the rail member 30. A front wall 22*c* of the shelf structure may have a label 23 attached for displaying identifying or other information relating to the floor-based lighting fixture 12. Shelf structure 22 also includes a rear wall 22*d* that is disposed in this embodiment between the rail member 30 and the display wall 15 (not shown in FIG. 2 for purposes of clarity and simplicity). The four walls of shelf structure 22 are joined by top wall 22*e*, which is adapted to support a truncated floor-based lamp 12.

The support member 30 also includes a bracket 24. In the embodiment shown in FIGS. 1 and 2, the bracket 24 includes a lip portion 24*a*, angled portion 24*b* and back portion 24*c* which extends along the display wall 15 (not shown) and terminates between the wall 15 and rail member 30. The bracket 24 is attached to the underside of top wall 22*e* of the shelf structure 22 by lip portion 24*a*, which is disposed substantially parallel to the top wall 22*e*. Angled portion 24*b* of the bracket reinforces and supports the shelf structure 22, and back portion 24*c* of the bracket of this embodiment extends upwardly along the display wall or other vertical surface to which the display system 10 can be attached. The back portion 24*c* of the bracket can be attached either to the rear surface of the rail member 30, or to the display wall 15 or other vertical surface, or both, for additional stability.

Various configurations of the bracket 24 exist in accordance with the embodiment of the invention shown in FIG. 2. For example, while one bracket 24 is shown attached at lip portion 24*a* to top wall 22*e* approximately along a center line thereof, two brackets may be provided, each attached by a lip portion to the top wall 22*e* adjacent opposite sides thereof. Such brackets may alternatively be attached to side walls 22*a*, 22*b*, instead of top wall 22*e*. Additional brackets can be provided as needed to support heavier lighting fixtures. In addition, as described in further detail below with reference to FIGS. 4 and 6A-6B, bracket 24 may include an angled portion attached at one end to the shelf structure 22 and having a lip portion at an opposite end, for attachment to a second rail member 30.

Figure 3:
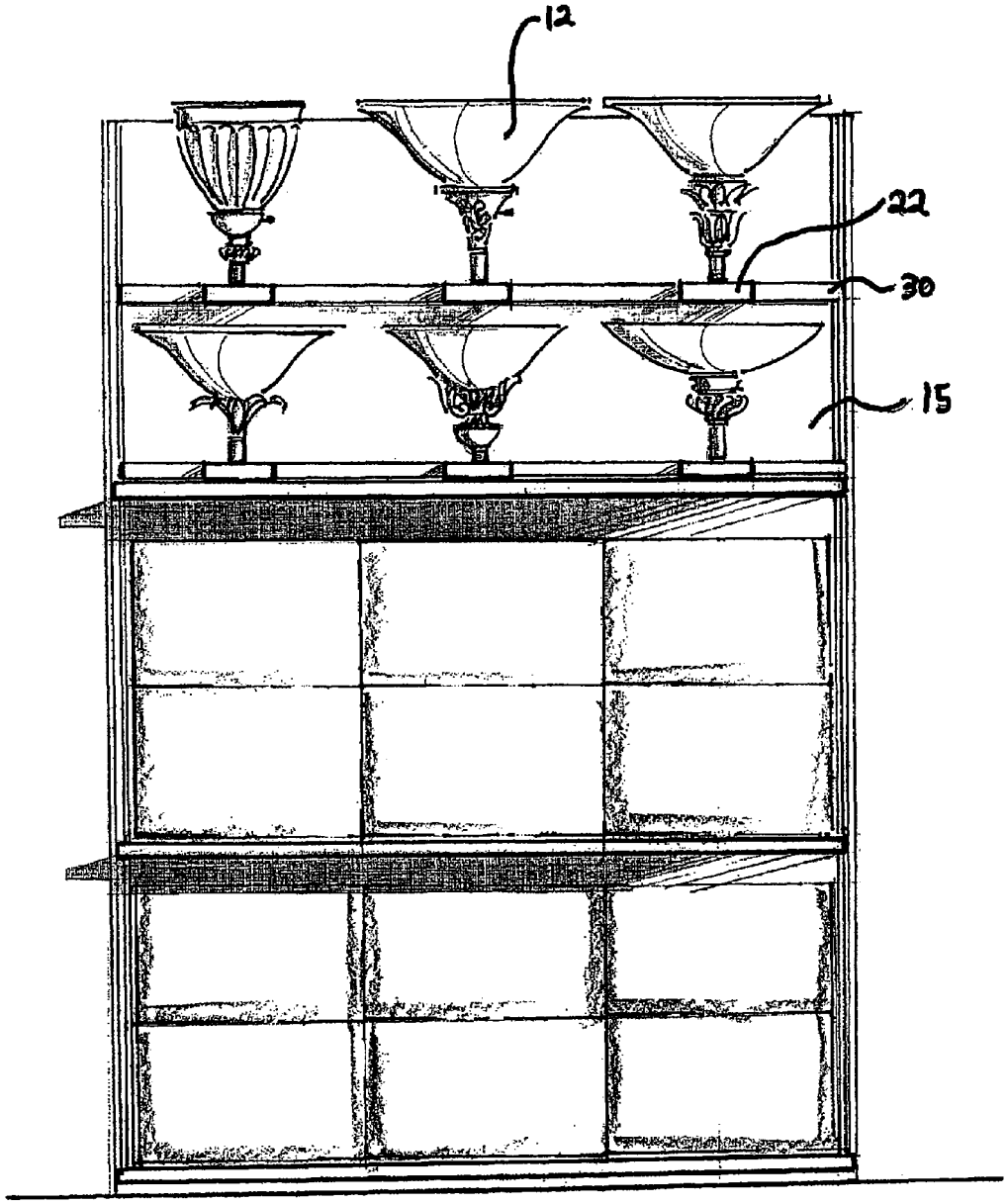
FIG. 3 is a schematic drawing of a front view of a configuration of lighting fixture display systems, showing a plurality of floor-based lighting fixtures supported by the display system mounted on a display wall.

As shown in FIG. 2, the rail member 30 horizontally extends along the display wall 15 and provides an electrical connection to which cord 35 from the lighting fixture 12 may be connected. Although only one lighting fixture display system 10 is illustrated in FIGS. 1 and 2, a plurality of display systems 10 may be attached along rail member 30, and as shown in FIG. 3, more than one rail member may be provided, so that first and second display rows are created along first and second rail members with a plurality of display systems. The configuration of display systems shown in FIG. 3 can be varied, and each display system can be moved or removed easily, to update the display system, or to repair or replace the fixture supported thereby, or to accommodate differently sized fixtures in the display.

With reference to FIG. 3, which is a front view of one exemplary configuration of a lighting fixture display system, showing a plurality of floor-based lighting fixtures 12 supported by support members 22 mounted on rail members 30 which are attached to a display wall 15. In this configuration, a variety of truncated floor-based lighting fixtures can be displayed in multiple rows so that the decorative features of each fixture are easily viewable by a customer. This configuration also maximizes retailer space for displaying the decorative portion of such floor-based lighting fixtures. The display system shown in FIG. 3 displays six lighting fixtures, but as can be appreciated, the display wall 15 can accommodate additional rail members with several support members attached to each one.

Figure 4:
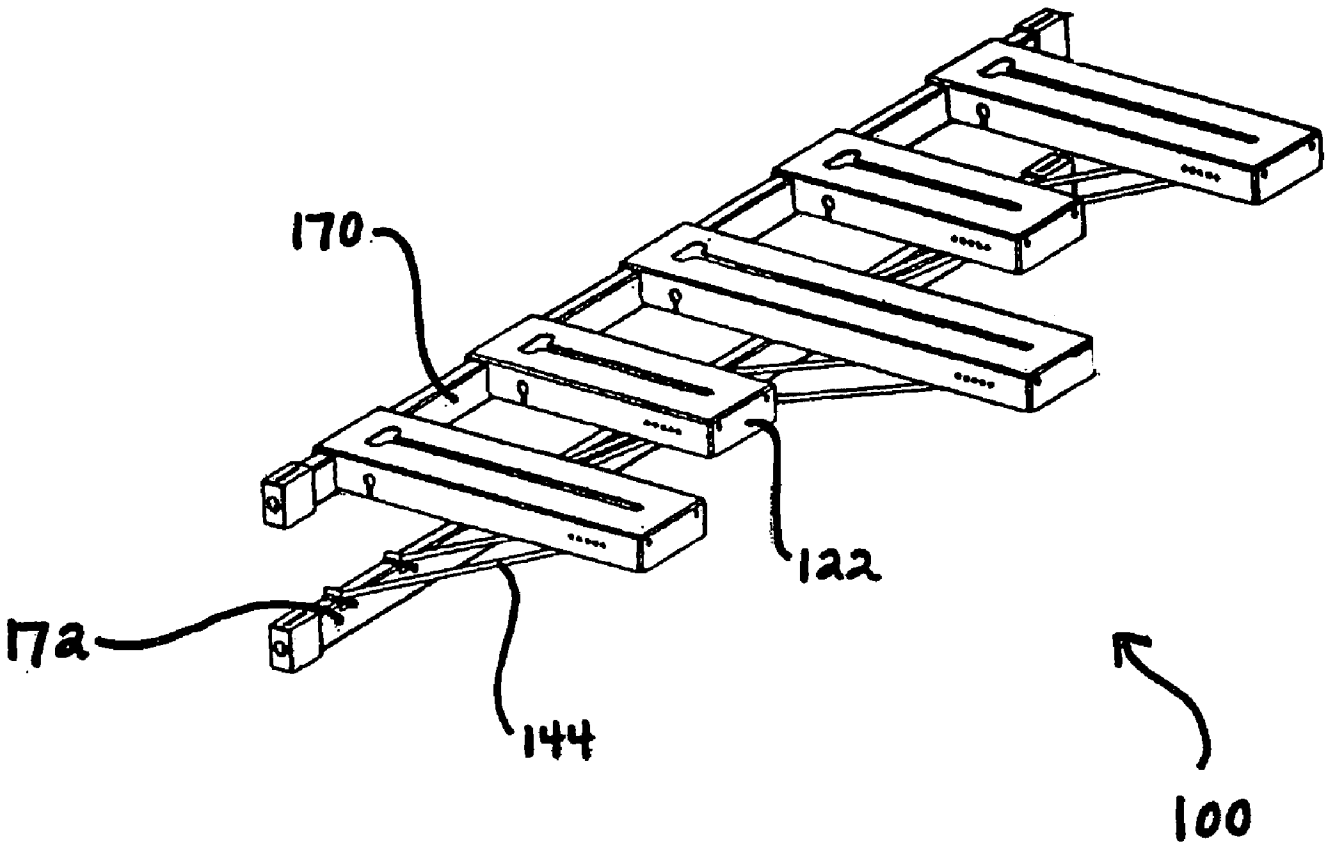
FIG. 4 is a schematic drawing of a perspective view of a lighting fixture display system showing a plurality of support members and rail members in accordance with another embodiment of the present invention.

FIG. 4 is a schematic perspective view of a lighting fixture display system 100 showing a plurality of support members and rail members in accordance with another embodiment of the present invention. In particular, a plurality of support members 120 including shelf structures 122 and brackets 144 are shown attached to first and second horizontal rail members 170 and 172, which are in turn mounted on or attached to a vertical display wall (not shown in FIG. 4 for purposes of clarity and simplicity). The shelf structures 122 can be of different lengths and widths. In the illustrative embodiment, each shelf structure 122 is mounted on a first rail member 170 and each bracket 144 is attached, at one end, to the shelf structure 122 and at the opposite end, to a second rail member 172.

Figure 5A:
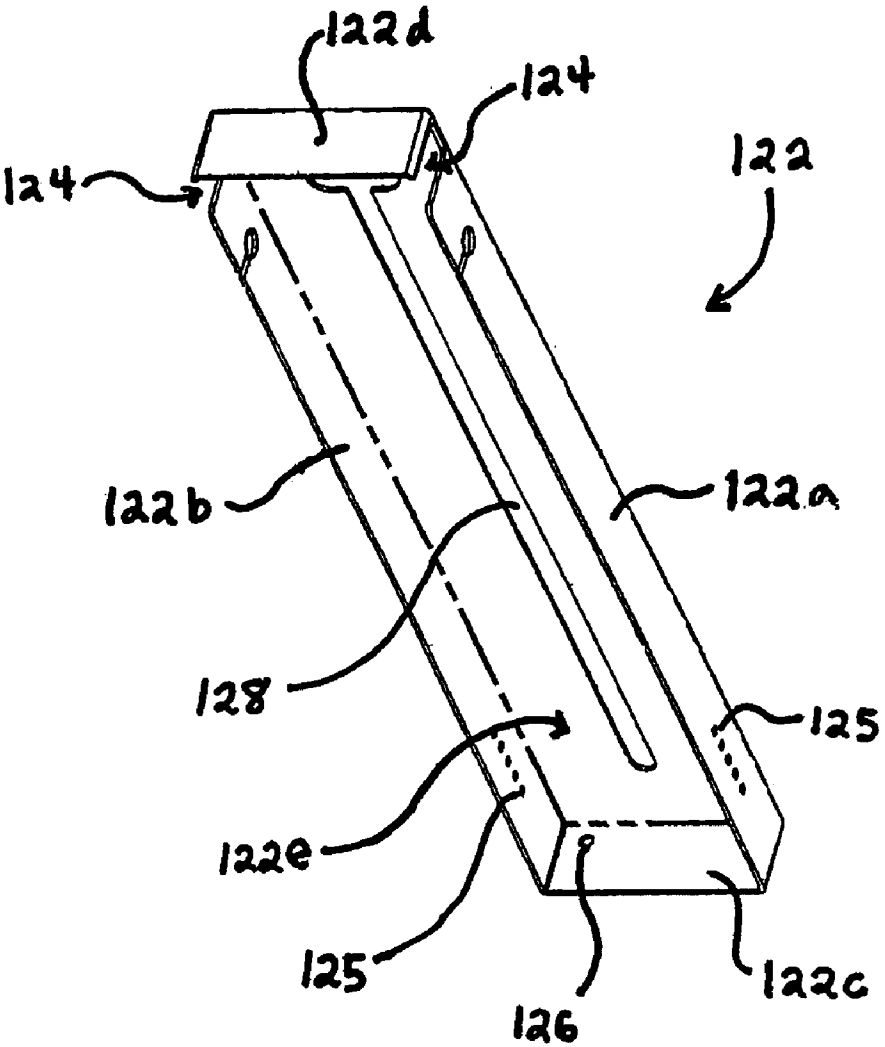
FIG. 5A is a perspective view of a shelf structure of the support member shown in FIG. 4.
Figure 5B:
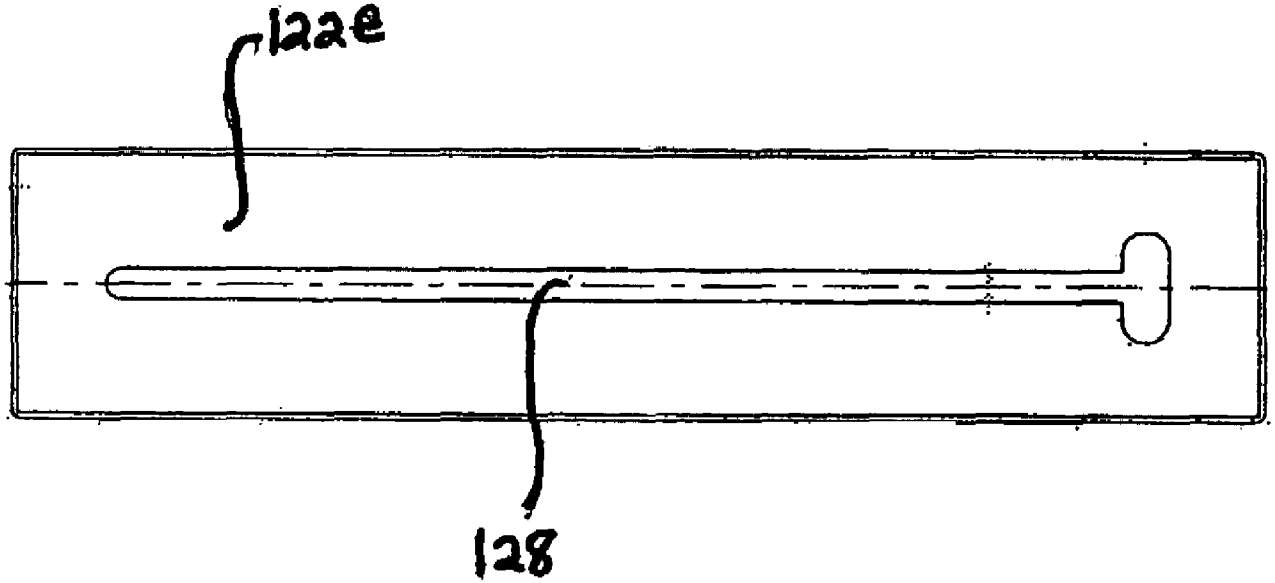
FIG. 5B is a top view of the shelf structure shown in FIG. 5A.
Figure 5C:
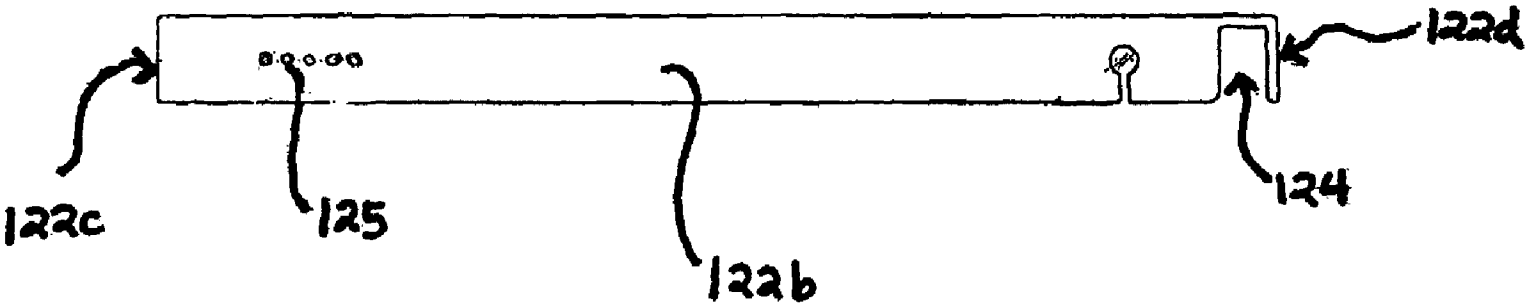
FIG. 5C is a side view of the shelf structure shown in FIG. 5A.

FIGS. 5A, 5B and 5C are related views of the shelf structure 122 of the support member 120 shown in FIG. 4. As can be seen in the perspective view of FIG. 5A, the shelf structure 122 includes side walls 122*a* and 122*b* that are adapted to receive or hook onto a first rail member 170. In particular, notches 124 are formed at one end of each of side walls 122*a*, 122*b*. The notches 124 match the dimensions of first rail member 170, so that the shelf structure 122 can be mounted on the rail member 170 (as shown in FIG. 4) by sliding the rail member into the space formed by the notches 124.

The shelf structure 122 also includes a front wall 122*c* that can have a label (not shown) attached for displaying identifying or other information relating to the floor-based lighting fixture (not shown in FIGS. 5A-5C) supported by the shelf structure 122. Alternatively, a bin or other container may be attached to the front wall 122*c* for holding brochures or specification sheets with further information relating to the lighting fixture displayed thereon or other items for sale. One or more holes 126 may be provided in front wall 122*c* for attachment of such label or bin to the front wall 122*c*. In addition, the front wall 122*c* serves the aesthetic purpose of obstructing the view of objects that are disposed under the shelf structure, such as the bracket and electrical cord. Shelf structure 122 also includes a rear wall 122*d* that is disposed in this embodiment between the rail member 170 and display wall (not shown in FIG. 5A for purposes of clarity and simplicity).

The four walls of shelf structure 122 described above are joined by top wall 122*e*, which is adapted to support a truncated floor-based lamp. With reference to FIG. 5B, which is a top view of the top wall 122*e* of the shelf structure, an aperture 128 is formed in the top wall 122*e* to accommodate a truncated floor-based lamp and the electrical connection thereto. In particular, the aperture 128 is a narrow elongated opening in the top wall having a larger portion at one end in order to permit the plug of an electrical cord from the lighting fixture to pass through the top wall for connection to an outlet in the rail member, as will be described further below. As can be appreciated, the shape and size of the aperture 128 in the top wall 122*e* of the shelf structure may vary, but it must have a portion large enough to accommodate an electrical cord plug in order for the lighting fixture to be connected to an electrical outlet without interfering with the display system.

FIG. 5C is a side view of side wall 122*b* shown in FIG. 5A. The features of the side wall 122*b* shown in FIG. 5C are also present in side wall 122*a* (not shown in FIG. 5C). In particular, side wall 122*b* has a notch 124 at one end for receiving a rail member. Side wall 122*a* also has a notch 124 in a corresponding end, so that the shelf structure can be mounted on rail member 170 (as shown in FIG. 4). Side wall 122*b* also includes a series of holes 125, to which one end of a bracket (not shown in FIG. 5C) may be attached. Similarly, side wall 122*a* may include such holes in order for one end of a second bracket to be attached thereto. By providing a series of holes 125 in each side wall 122*a*, 122*b*, the angle or height of the shelf structure relative to a display wall and relative to other rail members can be easily adjusted. For example, if second rail member 172 (shown in FIG. 4) is further from first rail member 170, the bracket should be attached to one of the holes closer to notch 124; if the second rail member 172 is closer to first rail member 170, the bracket should be attached to one of the holes closer to front wall 122*c*.

Figure 6A:
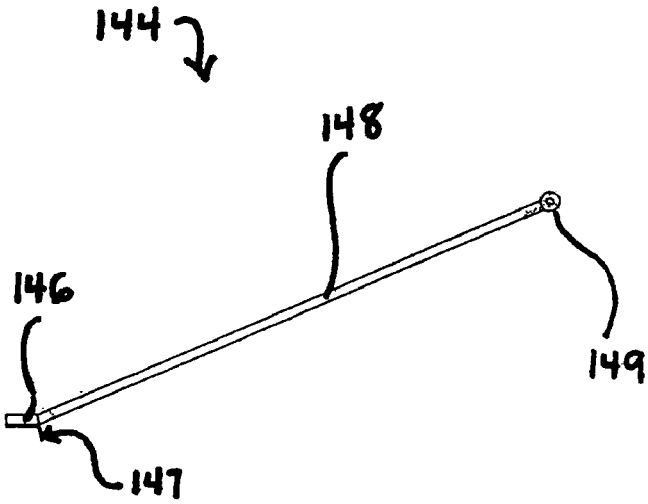
FIG. 6A is a schematic side view of a bracket of the support member shown in FIG. 4.
Figure 6B:
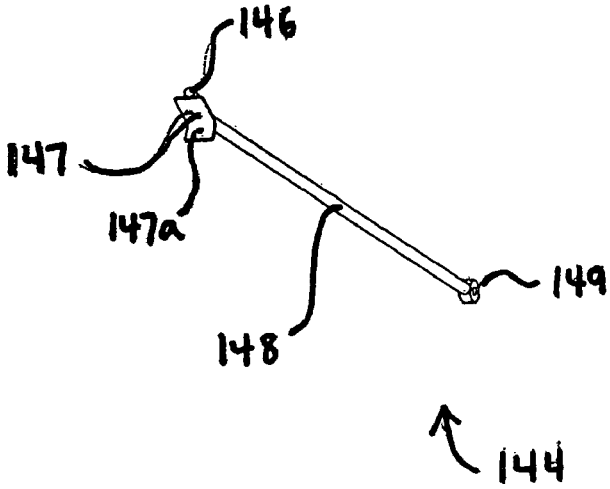
FIG. 6B is a schematic perspective view of the bracket shown in FIG. 6A.

The bracket member 144 used in the illustrative embodiment of the invention is shown in more detail in FIGS. 6A and 6B. The bracket 144 comprises an elongated body 148 with a foot portion 146 which can rest on top of the second rail member 172 (as shown in FIG. 4). The foot portion 146 may be formed with or attached to an angled bracket 147 that reinforces the foot portion 146 and is adapted to be positioned against the second rail member. As can be seen in FIG. 6B, the angled bracket 147 may be formed with a hole 147*a* so that it can be fastened to the rail member 172. On the opposite end of the elongated body 148 of the bracket 144 is a ring-like attachment member 149 having an opening and adapted to be attached to an inside surface of a side wall 122*a* or 122*b* of the shelf structure. More particularly, the opening shown in ring-like member 149 can be positioned adjacent one of the holes 125 in side wall 122*a* or 122*b* and joined thereto using a pin or by other means for attachment.

Figure 7A:
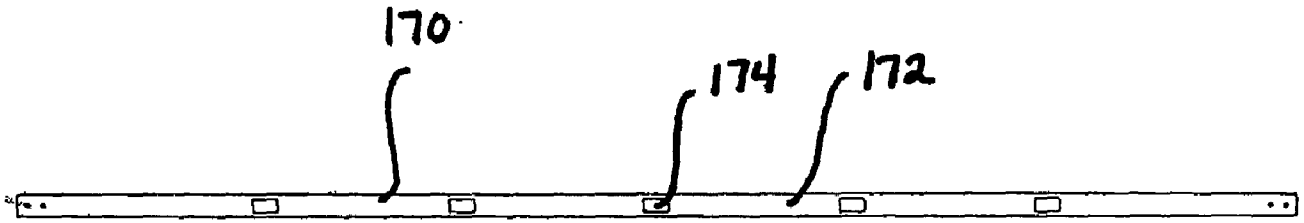
FIG. 7A is a schematic top view of a rail member of the display system shown in FIG. 4.
Figure 7B:
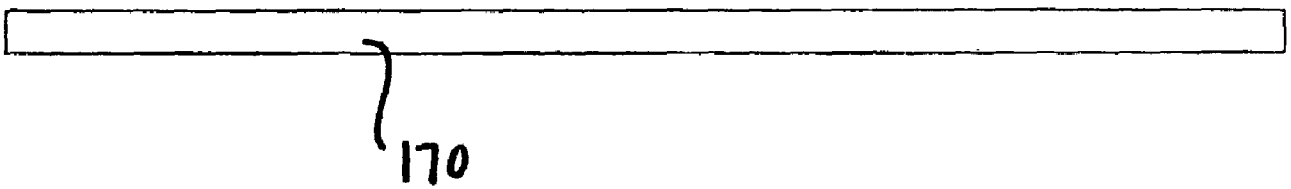
FIG. 7B is a front view of the rail member shown in FIG. 7A.

FIGS. 7A and 7B show the top and front views of a horizontal rail member 170 of the display system shown in FIG. 4. As can be seen, the rail member 170 has an elongated body 172 with connections 174 to a source of electricity disposed along the rail body 172 at regular intervals. Alternatively, the rail member 170 may be provided with apertures 174 to allow coupling to externally supplied plugs (as shown in FIG. 1). Although not shown in FIG. 7A or 7B, the rail member may be attached to or mounted on a display wall. It is understood that the second rail member 172 shown in FIG. 4 has the same features as the rail member 170 described herein, and that the second and any additional rail members may be similarly mounted on a display wall, forming first, second and subsequent display rows to which are attached a plurality of support members for supporting a variety of truncated floor-based lighting fixtures.

As can be appreciated from the above-described embodiments of the invention, the lighting display system offers flexibility in many aspects, including the spacing of support members on a rail, to allow either more or fewer lighting fixtures to be displayed along any one horizontal display row. Another aspect of the lighting display system that provides flexibility is in the spacing of horizontal rail members from each other, to accommodate varying heights of truncated stems of floor-based lighting displays and to permit more or fewer numbers of horizontal display rows. In addition, the lighting display system of the present invention may be used to display lighting fixtures other than floor-based lamps and torchieres, which may have different spacing requirements and can be accommodated by the horizontal and vertical flexibility of the present invention. In any configuration, the lighting display system described herein is capable of displaying a greater number of lamps than would otherwise be possible in a lighting fixture retailer's display showroom.

In accordance with the illustrative embodiments described herein, a lighting fixture can be displayed on the lighting display system of the present invention by providing a rail member and one or more support members, each of which includes a shelf structure that is adapted to receive the rail member at one end and a bracket coupled between each shelf structure and the rail member. As described above, the shelf structure includes an aperture, so that a lighting fixture may be installed on the shelf structure by inserting the electrical cord of the lighting fixture through the aperture. The plug of the electrical cord may then be inserted into an electrical connection in the rail member, or through an aperture in the rail member which allows coupling to an electrical connection, so that the lamp on display may be switched on and off.

The shelf structure receives the rail member in notches formed therein, so that the shelf structure may slide along the length of the rail member. The display of the lighting fixture may be adjusted horizontally along the horizontal display row by detaching the bracket from the rail member and sliding the shelf structure along the length of the rail member to the desired position, and then attaching the bracket to the rail member at the new position. The lighting fixture display may also be adjusted vertically, by detaching the bracket from the rail member, removing the shelf structure from the rail member, and attaching the support member (shelf structure and bracket) to a second or other rail member positioned above or below the original rail member. Moreover, the distance between horizontal display rows in the lighting display system may be adjusted by detaching the bracket from the rail member and attaching it to a second or other rail member.

As can be further appreciated, a lighting fixture may be easily repaired or replaced by removing it from the support member, which involves removing the plug of the fixture from the electrical power source, such as the connection provided by or accommodated by the rail member, pulling the plug and cord of the fixture back through the aperture of the shelf structure, and removing the fixture from the support member.

It is intended that the appended claims be interpreted as including the embodiments described herein, the alternatives mentioned above, and all equivalents thereto.

What is claimed is:

1. A lighting fixture display system, comprising:

a light support member adapted to support a lighting fixture, the light support member including a shelf structure and a bracket for attachment to the shelf structure; a rail member coupled to the light support member; and a truncated floor lamp having a truncated stem coupled to the light support member.

2. The lighting fixture display system in accordance with claim 1, wherein the shelf structure is adapted to receive and be supported by a segment of the rail member.

3. The lighting fixture display system in accordance with claim 1, wherein the bracket includes first and second ends, the first end attached to the shelf structure, and the second end attached to the rail member.

4. The lighting fixture display system in accordance with claim 1, comprising a plurality of light support members disposed along the rail member, each of the light support members adapted to support a respective lighting fixture for display.

5. The lighting fixture display system in accordance with claim 4, comprising a plurality of rail members, each of the light support members coupled to and supported by one of the rail members to provide a plurality of display rows.

6. The lighting fixture display system in accordance with claim 5, further comprising a display wall, to which the plurality of rail members are horizontally attached to form a plurality of variously configurable horizontal display rows.

7. The lighting fixture display system in accordance with claim 1, wherein the rail member includes means for connecting the lighting fixture to an electrical source.

8. The lighting fixture display system in accordance with claim 6, wherein each of the respective lighting fixtures comprises a truncated floor lamp having a truncated stem coupled to the light support member, and wherein the plurality of light support members comprise different sized light support members adapted to support different-sized lamps.

9. The lighting fixture display system in accordance with claim 8, wherein the horizontal display rows are positioned at a distance from one another relative to the height of the truncated stem of the lighting fixtures disposed thereon.

10. A lighting fixture display system, comprising:

a plurality of light support members, each of the light support members including a shelf structure and a bracket with means for attachment to the shelf structure;

a plurality of lighting fixtures, each of the lighting fixtures being supported by a respective one of the plurality of light support members, and at least one of the lighting fixtures being a truncated floor lamp having a truncated stem; and a rail member including means for connecting the lighting fixtures to an electrical source, wherein each one of the plurality of light support members is coupled to the rail member.

11. The lighting fixture display system in accordance with claim 10, wherein each of the plurality of light support members is disposed along the rail member so as be adapted to support a respective one of the plurality of lighting fixtures without interfering with an adjacent lighting fixture supported by another light support member.

12. The lighting fixture display system in accordance with claim 10, further comprising:

a plurality of rail members to which the plurality of light support members are coupled, forming at least first and second horizontal display rows, and a display wall on which the plurality of rails may be mounted, wherein a first plurality of light support members are coupled to a first rail member and disposed along the first horizontal display row and a second plurality of light support members are coupled to a second rail member and disposed along the second horizontal display row, and wherein a first plurality of lighting fixtures are supported by selected ones of the first plurality of light support members, and a second plurality of lighting fixtures are supported by selected ones of the second plurality of light support members.

13. The lighting fixture display system in accordance with claim 10, wherein each of the plurality of light support members comprises a plurality of brackets, each of the brackets being attached, at one end, to the respective shelf structure of the light support member, and each of the brackets being attached, at an opposite end, to one of the plurality of rail members.

14. The lighting fixture display system in accordance with claim 13, wherein each of the plurality of light support members is adapted to support a truncated floor lamp.

15. The lighting fixture display system in accordance with claim 14, wherein the shelf structure of each of the plurality of light support members is formed with an aperture through which an electrical cord can be inserted and connected to the means for connecting the lighting fixture to an electrical source provided by one of the plurality of rail members.

16. The lighting fixture display system in accordance with claim 14, wherein the truncated floor lamp has a truncated stem coupled to the light support member, and wherein the plurality of light support members comprise different-sized light support members adapted to support different-sized lamps.

17. The lighting fixture display system in accordance with claim 16, wherein the rail members are positioned at a distance from one another relative to the height of the truncated stem of the lighting fixtures disposed thereon.

18. A method of constructing a lighting fixture display system, comprising the steps of:

providing a rail member and a plurality of light support members, each light support member including a shelf structure and a bracket, each shelf structure adapted to receive, at one end, the rail member;

connecting each shelf structure to the rail member with a bracket; and installing a plurality of lighting fixtures on the shelf structures of the light support members, at least one of the lighting fixtures being a truncated floor lamp having a truncated stem.

19. The method according to claim 18, further comprising the step of removing a selected one of the lighting fixtures from one of the light support members without interfering with lighting fixtures supported by adjacent light support members.

20. The method according to claim 18, wherein the installing step is carried out by installing each of the plurality of lighting fixtures on a respective one of the shelf structures.

21. The method according to claim 20, wherein each of the plurality of light support members is positioned on the rail member so that each one of the lighting fixtures supported by a respective one of the light support members does not interfere with a lighting fixture supported by an adjacent light support member.

22. The method according to claim 18, wherein the providing step comprises providing a plurality of rail members and a plurality of shelf structures and wherein said plurality of rail members and plurality of light support members define at least first and second display rows; the connecting step comprises connecting a first plurality of shelf structures to a first rail member with a first plurality of brackets and connecting a second plurality of shelf structures to a second rail member with a second plurality of brackets; and the installing step comprises installing a first plurality of lighting fixtures along the first display row, and installing a second plurality of lighting fixtures along the second display row.

23. The method according to claim 22, wherein the providing step further comprises providing a shelf structure having an aperture and the installing step of installing a plurality of lighting fixtures on the shelf structures further comprises inserting an electrical cord of each of the plurality of lighting fixtures through the aperture of each shelf structure so that each of the light support members supports a truncated floor-based lighting fixture.

24. The method according to claim 22, wherein the step of providing a plurality of light support members comprises providing a plurality of different-sized light support members that are adapted to support different-sized lamps.

25. The method according to claim 24, wherein the display rows are positioned at a distance from one another relative to the height of the truncated stem of the lighting fixtures disposes thereon.

* * * * *